US005927494A

United States Patent [19]

Fowler et al.

[11] Patent Number: 5,927,494

[45] **Date of Patent: *Jul. 27, 1999**

[54] CARTON WITH ANGLED CORNER WALLS

[75] Inventors: James L. Fowler, Sapulpa, Okla.; Charles E. Wood, Arlington, Tex.

[73] Assignee: Green Bay Packaging, Inc., Green Bay, Wis.

[ * ] Notice: This patent issued on a continued prosecution application filed under 37 CFR 1.53(d), and is subject to the twenty year patent term provisions of 35 U.S.C. 154(a)(2).

[21] Appl. No.: 08/905,916

[22] Filed: Aug. 4, 1997

Related U.S. Application Data

[63] Continuation of application No. 08/577,306, Dec. 22, 1995, abandoned.

[51] Int. Cl.[6] ..... B65D 85/66

[52] U.S. Cl. ..... 206/391; 206/396; 206/303; 206/408

[58] Field of Search ..... 206/391, 395–397, 206/389, 303, 408, 446, 493

[56] References Cited

U.S. PATENT DOCUMENTS

| | | | |
|---|---|---|---|
| 3,115,376 | 12/1963 | Cupo | 206/391 |
| 3,280,987 | 10/1966 | Steinbock | 206/391 |
| 3,613,973 | 10/1971 | Jaeschke | 206/395 |
| 4,326,631 | 4/1982 | Annand | 206/389 |
| 5,141,108 | 8/1992 | Roccaforte | 206/397 |
| 5,390,790 | 2/1995 | Straub et al. | 206/408 |

*Primary Examiner*—Paul T. Sewell
*Assistant Examiner*—Nham T. Lam
*Attorney, Agent, or Firm*—Andrus, Sceales, Starke & Sawall

[57] ABSTRACT

A carton for packaging a series of rolls of web material includes parallel, opposite side walls and angled, corner walls provided at opposite corners of the carton. The rolls are positioned within the carton such that the material of the roll adjacent each corner wall engages the corner wall. Top and bottom end flaps extend from each of the side walls, for enclosing the top and bottom ends of the carton. Cut-out retainer flaps are formed in two of the top end flaps, for engagement within an internal passage defined by the core of the roll of material therebelow to retain the rolls of material in position within the interior of the carton.

12 Claims, 3 Drawing Sheets

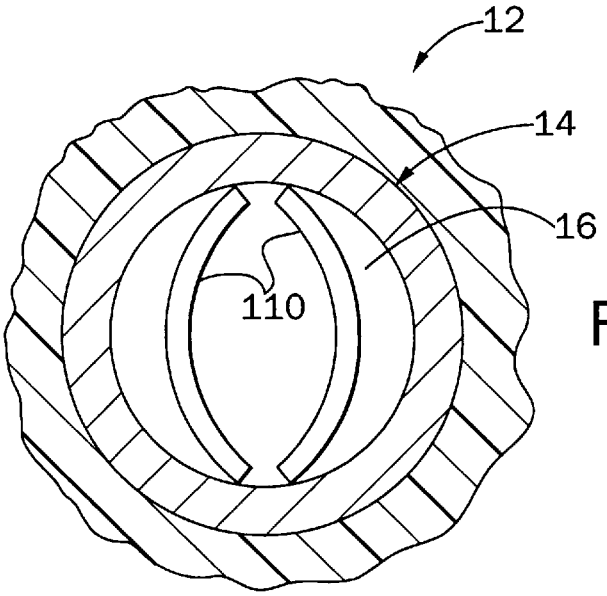
FIG. 6
FIG. 7
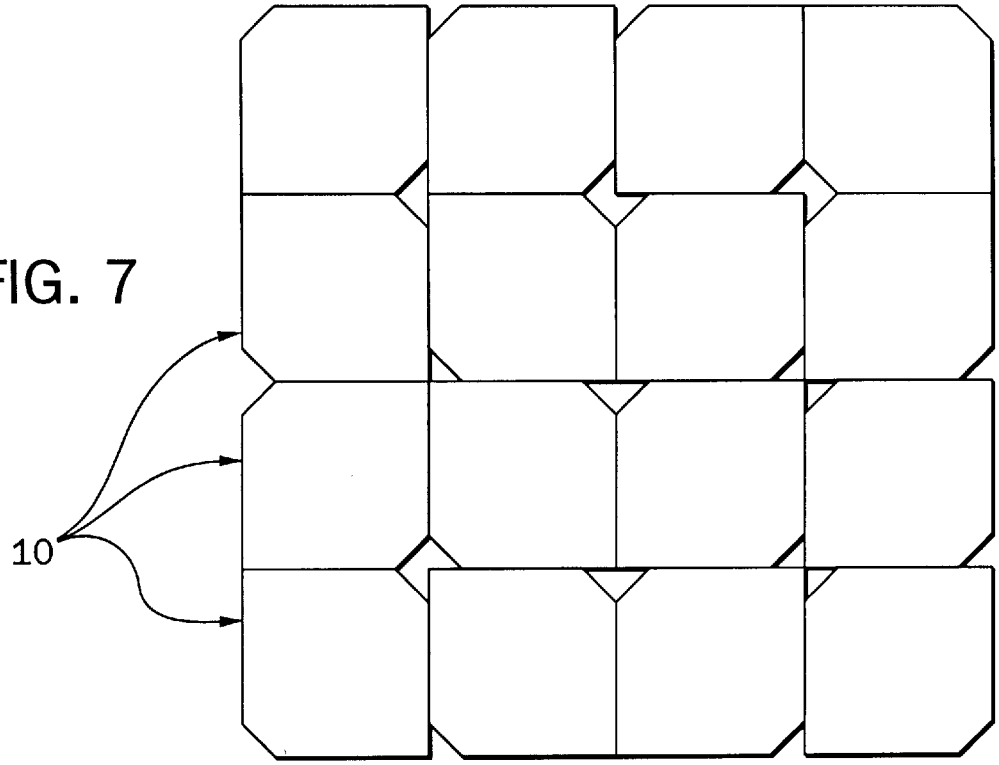

CARTON WITH ANGLED CORNER WALLS

CROSS-REFERENCE TO RELATED APPLICATION

This application is a continuation of application Ser. No. 08/577,306, filed Dec. 22, 1995, now abandoned.

BACKGROUND AND SUMMARY OF THE INVENTION

This invention relates to a container or carton, and more particularly to a carton for packaging and enclosing a number of rolls of material.

In the past, it has been known to package web or film rolls using a conventional rectangular box or carton. The rolls are placed within the box such that each roll is located in one corner of the box. Partitions, such as panels of corrugated board, are used to keep the rolls out of contact with each other. The boxes of rolls are stacked in layers on a pallet, and the palletized boxes are then wrapped with a stretch wrap material for binding the boxes and pallet into an integral shipping unit.

While the above-described shipping arrangement is generally satisfactory, there remains one potentially serious drawback in that the outer corners of the palletized boxes are unsupported. That is, the outer corners of the palletized unit consists of box corners defining an internal air space. When the palletized boxes are wrapped using stretch film, the forces exerted on the box corners by the film are often sufficient to collapse the box corners inwardly toward the roll adjacent the box corner. This provides an unsightly palletized unit which is objectionable to customers. Further, it is possible that the crushing forces exerted on the box corners may be significant enough to damage the web material on the corner roll during shipping and handling of the palletized unit. In any event, the crushing of the box corners can lead a customer to believe that the material contained within the box has been damaged.

It is an object of the present invention to overcome the above-noted drawbacks in the prior art by providing a carton construction which eliminates the air spaces at the outer corners of the palletized unit. It is a further object of the invention to provide a carton construction for shipping rolls of web material which provides support at certain of the carton corners for the rolls of web material adjacent thereto. Yet another object of the invention is to provide such a carton which is relatively simple to construct and to load with rolls of web material.

In accordance with one aspect of the invention, a carton is made up of first, second, third and fourth side walls which are interconnected such that the first and third side walls are substantially parallel to each other and the second and fourth side walls are substantially parallel to each other. A pair of angled corner walls are located such that one corner wall extends between and interconnects the first and second side walls and the other corner wall extends between and interconnects the third and fourth side walls. With this arrangement, the angled corner walls are on substantially opposite corners of the carton. The carton further includes end wall structure which encloses opposite ends of the carton defined by the side walls and the corner walls. The rolls of material are placed within the carton such that two of the rolls are engaged by the angled corner walls. The carton is constructed from a blank which defines a pair of spaced ends. Opposite ends of the blank are interconnected together such that the blank ends cooperate to define one of the angled corner walls. The end wall structure includes a series of top end flaps foldably interconnected with top ends defined by the first, second, third and fourth side walls, and a series of bottom end flaps foldably interconnected with bottom ends defined by the first, second, third and fourth side walls. Opposite ones of the top and bottom end flaps include an angled notch which defines an angled side edge, and the angled side edges are located adjacent the angled corner walls. Opposite ones of the top end flaps include retainer structure, in the form of a pair of foldable flaps, which is engageable within an internal passage defined by the core of each roll of web material. The retainer flaps have a width greater than the inside diameter of the core such that when the flaps are folded downwardly and toward each other, the flap ends engage the internal surface of the core and the flaps are deformed so as to securely engage the core with the upper end flap. This prevents any shifting of the rolls during shipment, thus eliminating the need for partitions between the rolls and preventing the rolls from rubbing against each other.

The invention further contemplates the combination of a carton with a series of rolls of web material, and a method of packaging rolls of web material, substantially in accordance with the foregoing summary.

Various other features, objects and advantages of the invention will be made apparent from the following description taken together with the drawings.

BRIEF DESCRIPTION OF THE DRAWINGS

The drawings illustrate the best mode presently contemplated of carrying out the invention.

In the drawings:

FIG. 6 is a partial section view taken along line 6—6 of FIG. 3; and FIG. 7 is a top plan view showing the arrangement of a layer of the cartons of FIG. 1 used to form a palletized unit of cartons.

DETAILED DESCRIPTION OF THE INVENTION

Figure 1:
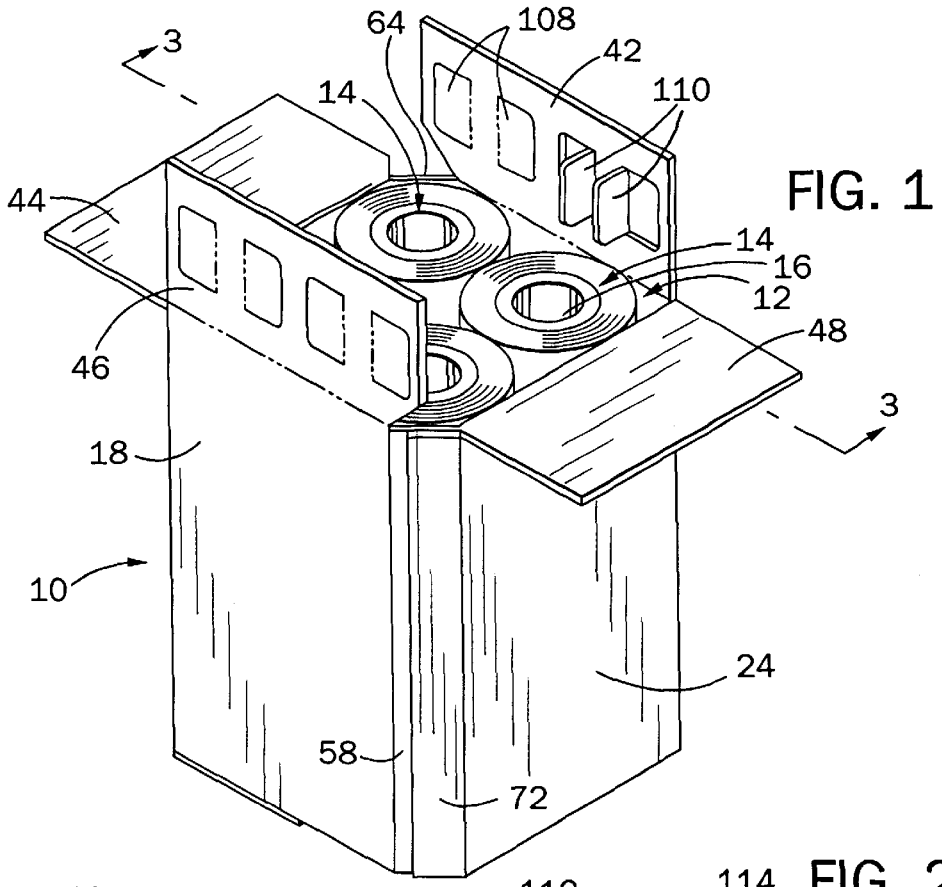
FIG. 1 is an isometric view showing rolls of web material packaged within the carton constructed according to the invention.

FIG. 1 illustrates a carton 10 for packaging a number of rolls 12 of film-type web material, each of which includes a core 14 defining an internal passage 16.

Carton 10 is preferably formed of a material such as corrugated paperboard, or any other satisfactory material. Carton 10 includes a first side wall or panel 18, a second side wall or panel 20, a third side wall or panel 22, and a fourth side wall or panel 24. Side walls 18, 20, 22 and 24 each define upper ends terminating at fold lines 26, 28, 30 and 32, respectively, and lower ends terminating at fold lines 34, 36, 38 and 40, respectively. Top end flaps 42, 44, 46 and 48 extend from the upper ends of side walls 18, 20, 22 and 24, respectively, and bottom end flaps 50, 52, 54 and 56 extend from the lower ends of side walls 18, 20, 22 and 24, respectively.

Figure 2:
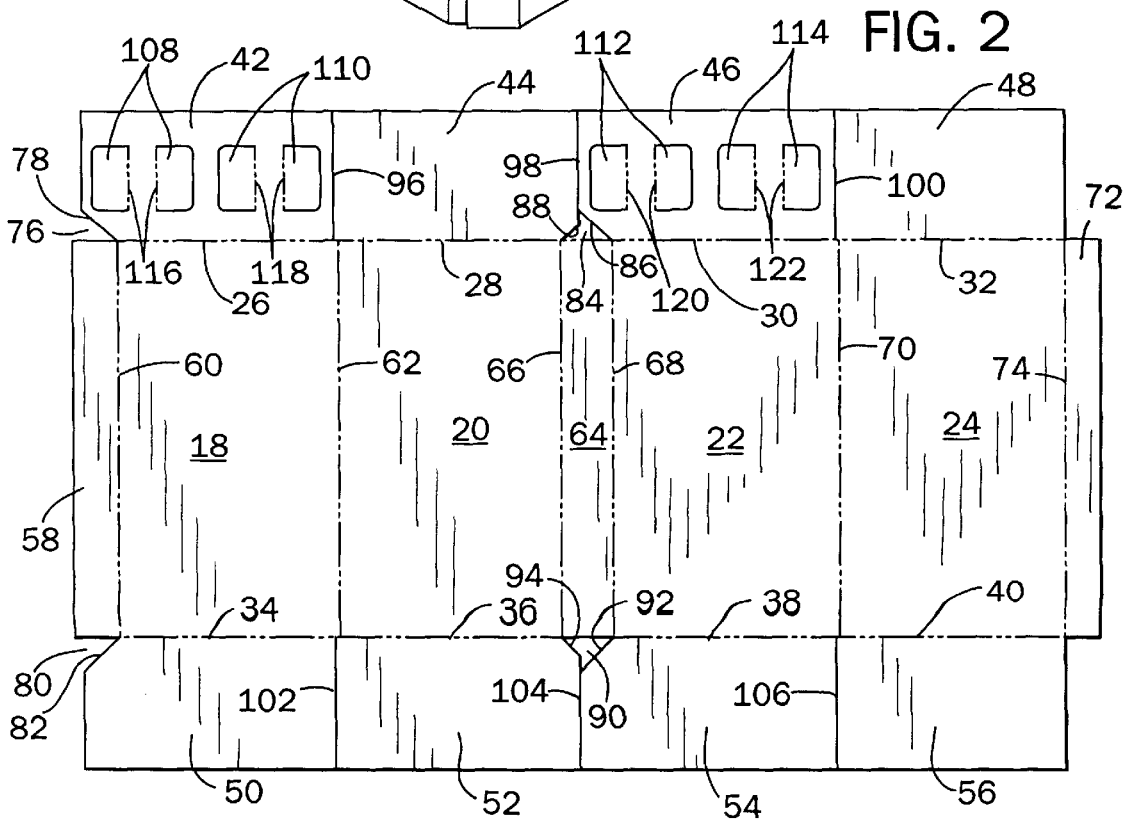
FIG. 2 is a plan view of a blank used to construct the carton of FIG. 1.

FIG. 2 illustrates a cut, slit and scored blank of corrugated paperboard from which carton 10 is constructed. Referring to FIG. 2, an end flap 58 extends from side wall 18, and is separated therefrom by a fold line 60. A fold line 62 is located between side walls 18 and 20, and a corner wall 64 is located between side walls 20 and 22, being separated therefrom by fold lines 66, 68, respectively. A fold line 70 separates side walls 22 and 24. An end flap 72 extends from side wall 24, being separated therefrom by a fold line 74. Corner wall 64 and end flaps 58, 72 have a height equal to the height of side walls 18–24.

As shown in FIG. 2, a notch 76 is formed between the upper end of end flap 58 and top end flap 42, defining an angled edge 78 which extends between fold line 26 and the side edge of top end flap 42. Notch 76 also defines the upper edge of end flap 58. Similarly, a notch 80 is formed between the lower end of end flap 58 and bottom end flap 50, defining an angled edge 82 which extends between fold line 34 and the side edge of bottom end flap 50. A notch 84 is formed above the upper end of corner wall 64, and defines an angled side edge 86 extending between fold line 30 and the side edge of top end flap 46. Notch 84 also defines an angled side edge 88 which extends between fold line 28 and the side edge of top end flap 44. A similar notch 90 is formed below corner wall 64, defining an angled side edge 92 which extends between fold line 38 and the side edge of bottom end flap 54, and an angled side edge 94 which extends between fold line 36 and the side edge of bottom end flap 52.

Top end flaps 42 and 44 are separated by a slit 96, top end flaps 44 and 46 are separated by a slit 98, and top end flaps 46 and 48 are separated by a slit 100. Similarly, bottom end flaps 50 and 52 are separated by a slit 102, bottom end flaps 52 and 54 are separated by a slit 104, and bottom end flaps 54 and 56 are separated by a slit 106.

Pairs of retainer flaps 108 and 110 are formed in top end flap 42, and pairs of retainer flaps 112, 114 are formed in top end flap 46. Retainer flaps 108, 110 are cut-out portions of top end flap 42, and are foldably interconnected therewith at fold lines 116, 118, respectively. Similarly, retainer flaps 112, 114 are cut-out portions of top end flap 46, and are foldably interconnected therewith at fold lines 120, 122, respectively.

Figure 4:
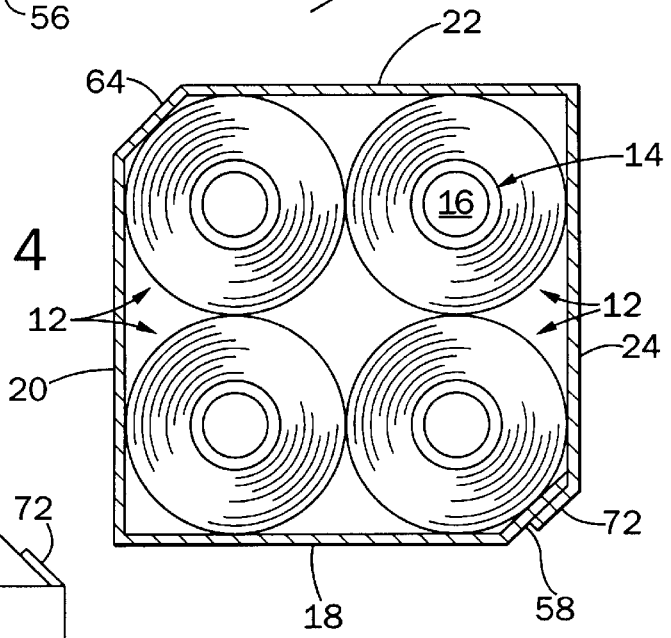
FIG. 4 is a section view taken along line 4—4 of FIG. 3.

Carton 10 is constructed from the blank of FIG. 2 by gluing, stapling or otherwise bonding end flaps 58 and 72 together as shown in FIGS. 1 and 4, such that end flap 72 overlaps end flap 58. When carton 10 is erected in this manner, end flaps 58 and 72 cooperate to define an angled corner wall between first side wall 18 and fourth side wall 24, located opposite corner wall 64.

Figure 5:
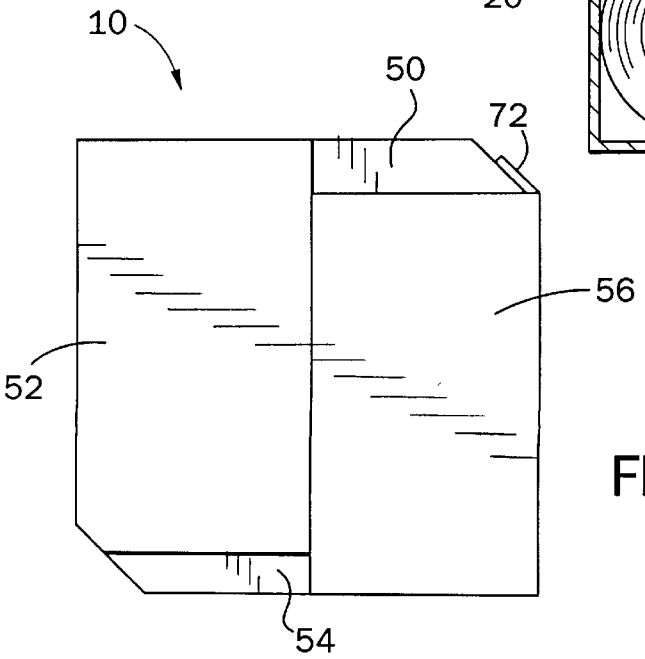
FIG. 5 is a bottom plan view of the assembled carton of FIG. 1.

In operation, after end flaps 58 and 72 are secured together, the operator then folds bottom end flaps 50 and 54 inwardly toward each other, and then folds bottom end flaps 52 and 56 inwardly toward each other over bottom end flaps 50 and 54. This causes bottom end flaps 50–56 to assume positions as shown in FIG. 5, such that angled side edge 82 of bottom end flap 50 is located adjacent the lower end of the corner wall defined by flaps 58 and 72, and angled side edge 92 of bottom end flap 54 is located adjacent the lower end of corner wall 64. Angled side edge 94 of bottom end flap 52 is also located adjacent the bottom end of corner wall 64, overlying angled side edge 92 of bottom end flap 54. Bottom end flaps 50–56 are then glued, stapled, taped or otherwise secured in their positions as shown in FIG. 5, to provide carton 10 with an open top in preparation for loading. The operator then places carton 10 such that its open top faces upwardly and sidewardly, so as to be positioned at an upwardly-facing angle relative to the operator. The operator then first loads a pair of rolls 12 into the bottom portion of open container 10, and places a panel of corrugated material over the bottom rolls. The operator then slides a pair of upper rolls 12 into open carton 10 on the panel. The panel is then removed, and the loaded carton 10 is placed in its position of FIG. 1 in which its bottom rests on a supporting surface and its top opens upwardly. In this position, the roll 12 adjacent corner wall 64 engages corner wall 64 and side walls 20 and 22 on either side of corner wall 64. Similarly, the opposite roll 12 engages the inside surface of flap 58 forming the opposite corner wall, and also engages side walls 18 and 24 on either side thereof. The other two rolls 12 engage side walls 18, 22 and 22, 24 adjacent the corners defined thereby, such that air spaces are located outwardly of such rolls 12. The edges of adjacent rolls 12 engage each other.

Figure 3:
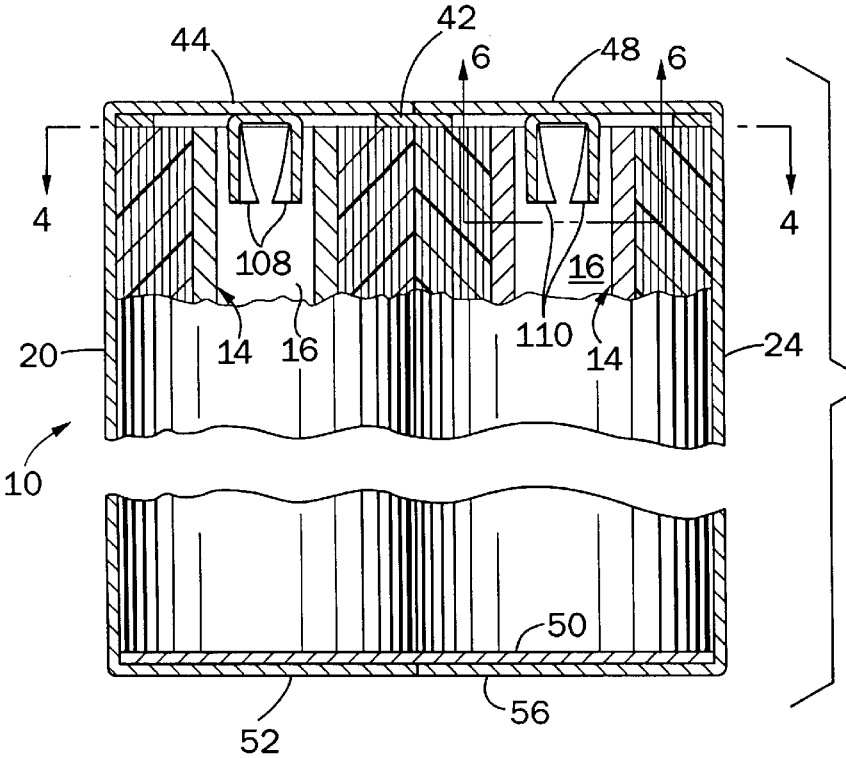
FIG. 3 is a section view, with portions broken away, taken along line 3—3 of FIG. 1.

Upper end flaps 42 and 46 are then folded inwardly toward each other so as to overlie the upper ends of rolls 12. In this position, angled side edge 78 of upper end flap 42 is located adjacent the upper end of the corner wall defined by flaps 58 and 72, and angled side edge 86 is located adjacent the upper end of corner wall 64. The operator then manually engages flaps 108 and 110 of upper end flap 42 to fold flaps 108 and 110 inwardly and together, such that flaps 108 and 110 are positioned within the internal passage 16 defined by the core 14 of the roll 12 positioned below flaps 108, 110. The operator then repeats this procedure for flaps 112, 114 of upper end flap 46. Retainer flaps 108–114 have a width which is greater than the diameter of passage 16, so that the ends of flaps 108–114 engage the inner surface of core 14 defining internal passage 16 and the portion of each flap between the ends is deformed inwardly toward the opposite flap in the pair, as shown in FIG. 3. This functions to bias and engage the flap ends with the internal surfaces of core 16, to securely lock the upper end of each roll 16 in position relative to its overlying upper end flap. The operator then folds upper end flaps 44 and 48 together over upper end flaps 42 and 46, and tapes or otherwise secures upper end flaps 44 and 48 together and to the side walls of container 10.

The operator then places container 10 on a pallet along with other loaded containers 10; and an example of a pallet layer of cartons 10 is shown in FIG. 7. In this arrangement, one of the angled corner walls, either angled corner wall 64 or the angled corner wall defined by flaps 58 and 72, is located at each of the outside corner of the layer of containers 10. After a desired number of successive layers of containers 10 are placed on the pallet to form a palletized unit, the palletized unit is wrapped using a conventional stretch wrapping machine such that the outer periphery of the palletized unit and the pallet are wrapped so as to secure the layers of containers 10 together and to the pallet. This arrangement of the palletized unit prevents unsupported carton corners from being located at the outer corners of the palletized unit. The outer corners of the palletized unit each present angled corner walls, such that any forces transferred to the carton by the stretch wrap are transferred directly to the roll 12 adjacent the corner, which forces are in turn transferred to adjacent cartons 10 through engagement of the adjacent rolls with each other. This provides internal support for rolls 12 as they are positioned in each layer, and minimizes any shifting of rolls 12 during transportation and handling, resulting in less damage to the material of rolls 12. In addition, the angled corner walls at the outside corners of the palletized unit prevent unsightly buckling or crushing of prior art cartons in which such corners were unsupported. Carton 10 eliminates the need for partitions between the rolls during shipment, due to engagement of retaining flaps 108–114 with the rolls cores.

Various alternatives and embodiments are contemplated as being within the scope of the following claims particularly pointing out and distinctly claiming the subject matter regarded as the invention.

We claim:

1. A carton, comprising:

first, second, third and fourth side walls arranged such that opposite side walls are substantially parallel to each other, wherein the first, second, third and fourth side walls each define a top end and a bottom end;

a pair of angled corner walls located one between and interconnecting the first and second side walls and one between and interconnecting the third and fourth side walls such that the angled corner walls are on opposite corners of the carton;

end wall structure for enclosing opposite ends of the carton defined by the side walls and the corner walls, wherein the end wall structure for enclosing at least one end of the carton comprises an end flap foldably interconnected with each of the first, second, third and fourth side walls at an end thereof to define opposed pairs of end flaps foldable toward each other; and a plurality of rolls of material contained within the carton, each roll of material containing a core defining an internal passage opening onto an end of the roll, and wherein each end flap in a first one of the opposed pairs of end flaps includes retainer structure, wherein the first opposed pair of end flaps are foldable to a closed position in which each end flap in the first opposed pair overlies one or more roll ends separate from the roll ends overlain by the other end flap, and wherein the end flap retainer structure is engageable within the internal passage of each core for maintaining the rolls of material in position within the carton.

2. The carton of claim 1, wherein the retainer structure comprises retainer flap structure foldably interconnected with each end flap in the first opposed pair of end flaps.

3. In combination, a plurality of rolls of material, each of which includes a core defining an internal passage, and a carton for receiving the rolls of material, the carton comprising:

first, second, third and fourth side walls interconnected such that the first and third walls are parallel to each other and the second and fourth walls are parallel to each other;

a pair of angled corner walls located such that a first one of the corner walls extends between and interconnects the first and second side walls and a second one of the corner walls extends between and interconnects the third and fourth side walls;

wherein the rolls of material and the angled corner walls are arranged such that each corner wall engages one of the rolls of material;

first and second end wall structures for enclosing opposite ends of the carton defined by the side walls and the corner walls, wherein at least one of the end wall structures includes an end flap foldably interconnected with each of the side walls to define opposed pairs of end flaps foldable toward each other, wherein each end flap in a first one of the opposed pairs of end flaps includes retainer flap structure, wherein the first opposed pair of end flaps are foldable to a closed position in which each end flap in the first opposed pair overlies one or more roll ends separate from the roll ends overlain by the other end flap, wherein the retainer flap structure is adapted for folding into and engaging the core internal passages for retaining the rolls of material in position within the container.

4. The combination of claim 3, wherein the carton is formed from a blank defining a pair of ends, and wherein one of the corner walls is formed by interconnecting the ends of the blank.

5. The combination of claim 3, wherein the retainer flap structure includes a pair of retainer flaps foldable toward each other so as to be in alignment with the core internal passage, and wherein each retainer flap has a transverse dimension greater than the transverse dimension of the core internal passage, such that the retainer flap ends engage an internal surface of the core defining the internal passage and the flap intermediate the flap ends is deformable toward the core to securely engage the retainer flaps with the core.

6. A carton, comprising:

a series of side walls interconnected together to define a carton interior extending between a top end and a bottom end;

top and bottom end wall structure interconnected with the series of side walls for enclosing the top end and the bottom end, respectively, of the carton interior; and wherein at least one of the top and bottom end wall structures comprises at least one end flap, wherein each end flap defines a peripheral edge and includes at least one interior retainer member, wherein each retainer member is cut out from the material of the end flap inwardly of the peripheral edge so as to be formed in the interior of the end flap, and is foldable relative to the end flap into engagement with an object received within the carton interior for maintaining the object in position within the carton interior.

7. The carton of claim 6, wherein the series of side walls include first, second, third and fourth side walls arranged such that opposite side walls are substantially parallel to each other, and further comprising a pair of angled corner walls located one between and interconnecting the first and second side walls and one between and interconnecting the third and fourth side walls, such that the angled corner walls are on opposite corners of the carton.

8. A carton arrangement, comprising:

a carton including side wall structure defining an internal cavity and an opening providing access to the internal cavity, wherein the carton further includes at least one end flap located relative to the side wall structure so as to selectively close the opening;

at least one pair of members received within the internal cavity, wherein each member defines an internal passage facing outwardly of the internal cavity at the opening;

wherein the end flap is connected to and extends from the side wall structure, and is movable to a closed position in which the end flap closes the opening and overlies the outwardly facing internal passage of at least one of the members; and wherein the end flap defines a peripheral edge and includes at least one internal retainer flap located inwardly of the peripheral edge and foldable relative to the end flap, wherein each retainer flap defines a transverse dimension greater than the transverse dimension of the internal passage and is located so as to be movable into the internal passage, and wherein each retainer flap is configured such that at least a pair of end portions defined by each retainer flap engage an internal surface defined by the internal passage to securely engage the retainer flap with the member.

9. The carton arrangement of claim 8, wherein each retainer flap is foldably interconnected with the end flap and defines a pair of end portions, wherein engagement of the retainer flap end portions with the internal surface is operable to laterally deflect the end portions relative to the remainder of the retainer flap located between the end portions.

10. The carton arrangement of claim 8, wherein each retainer flap is cut out from the material of the end flap of the peripheral edge.

11. The carton arrangement of claim 10, wherein a pair of retainer flaps are cut out from the material of the end flap at the location of each internal passage and are foldable away from the end flap into the internal passage.

12. The carton arrangement of claim 10, wherein a plurality of retainer flaps are cut out from the material of the end flap inwardly of the end flap peripheral edge.

* * * * *

UNITED STATES PATENT AND TRADEMARK OFFICE

CERTIFICATE OF CORRECTION

PATENT NO. : 5,927,494

DATED : July 27, 1999

INVENTOR(S) : JAMES L. FOWLER ET AL

It is certified that error appears in the above-indentified patent and that said Letters Patent is hereby corrected as shown below:

Claim 1, col. 5, line 17, after "walls" insert -- , --; Claim 10, col. 8, line 5, after "flap" (2nd occurrence) insert -- inwardly --.

Signed and Sealed this

Eighth Day of February, 2000

*Attest:*

*Attesting Officer*

Q. TODD DICKINSON

*Commissioner of Patents and Trademarks*